US010904986B1

(12) United States Patent
Reddy et al.

(10) Patent No.: US 10,904,986 B1
(45) Date of Patent: Jan. 26, 2021

(54) CIRCUIT INTERFACE

(71) Applicant: Light Power Technologies LLC, Pompano Beach, FL (US)

(72) Inventors: Rakesh Reddy, Boca Raton, FL (US); Kevin Doyle, Pompano Beach, FL (US)

(73) Assignee: Light Power Technologies, LLC, Pompano Beach, FL (US)

( * ) Notice: Subject to any disclaimer, the term of this patent is extended or adjusted under 35 U.S.C. 154(b) by 0 days.

(21) Appl. No.: 16/872,803

(22) Filed: May 12, 2020

(51) Int. Cl.

| | |
|---|---|
| ***H05B 37/00*** | (2006.01) |
| ***H05B 39/00*** | (2006.01) |
| ***H05B 47/155*** | (2020.01) |
| ***A61H 33/00*** | (2006.01) |
| ***H05B 47/21*** | (2020.01) |

(52) U.S. Cl.
CPC ..... *H05B 47/155* (2020.01); *A61H 33/005* (2013.01); *A61H 33/60* (2013.01); *H05B 47/22* (2020.01); *A61H 2201/50* (2013.01)

(58) Field of Classification Search
CPC .... H05B 47/155; H05B 47/22; A61H 33/005; A61H 33/60; A61H 2201/50
See application file for complete search history.

(56) References Cited

U.S. PATENT DOCUMENTS

| | | | | |
|---|---|---|---|---|
| 7,480,764 | B2 * | 1/2009 | Park | G11B 20/00695 369/275.3 |
| 10,299,342 | B1 * | 5/2019 | Reddy | F21V 23/0435 |
| 2006/0238931 | A1 * | 10/2006 | Cline | A61H 33/005 361/42 |
| 2008/0197788 | A1 * | 8/2008 | Conover | H05B 45/20 315/291 |
| 2017/0006693 | A1 * | 1/2017 | Raposo | G06F 3/038 |
| 2017/0209338 | A1 * | 7/2017 | Potucek | B25J 9/1694 |

* cited by examiner

*Primary Examiner* — Minh D A
(74) *Attorney, Agent, or Firm* — Clayton, McKay & Bailey, PC

(57) ABSTRACT

A circuit interface includes a plurality of inputs, an internal controller, and a communication module. Each of the inputs may be configured to connect to a respective high voltage relay output of a pool and/or spa control ("PSC") panel. The internal controller may be connected to the plurality of inputs, and together, the internal controller and the plurality of inputs can be configured to convert relay output signals into formatted data that includes an implementation protocol. The communication module can be configured to transmit the formatted data from the circuit interface. Conversions from the relay output signals to the formatted data can include specifying or configuring the formatted data to cause a device controller to operate devices corresponding to respective PSC panel relay outputs by directing individual low voltage supplies from a common low voltage source to the respective devices.

17 Claims, 8 Drawing Sheets

CIRCUIT INTERFACE

BACKGROUND

Colored lighting is becoming very popular in many industries (e.g., food service, entertainment, hotel, special events, etc.) with the advent of various light emitting diode ("LED") technologies, as well as other light or illuminating technologies. Many of these types of lights can change the color of light they display, as well function to create different lighting shows (e.g., synchronized displays of light, synchronized changing of colors, various sequences of both). As new lighting technologies have been developed, colored lights and lighting systems for pools have become ubiquitous. The pool and spa construction industry increasingly employs these different types of light technologies as pool lights to provide dynamic pool user experiences and versatile entertainment, therapy, and/or revenue generating options for pool owners.

For example, it is typical for many pools to have lights in the pool, one more lights in an adjoining spa, and a colored water capable display feature physically and/or operationally employed with one or more devices, such as submerged fountains (e.g., bubblers), laminar jets, waterfalls, and the like. Further, due to the compact design of many LED lighting technologies, in particular, a main body of water can have different zones of lighting. This allows for desired lighting effects—such as accent lighting, pool entry step lighting etc. In these and other types of zoned lighting systems, pool and spa owners and users typically desire, or react more positively to, systems in which zones of lights can be lit separately. For instance, a pool owner or user may want lights for a spa and laminar jets for the spa lit in a steady-state (e.g., continuously on) and set to one color or specific combination of colors. At the same time, the owner or user may have a light or lights for a pool turned off, intermittently turned on and off, displaying light of a color different than that of the spa, laminar jet, or both, or from each other in the case of multiple pool lights.

Pool and/or spa control ("PSC") panels are frequently installed with pools and spas to initiate, monitor, and control functions of equipment generally responsible for, or encompassing of, overall pool and/or spa operations. Such PSC panels may operate to monitor, generate alerts or notifications regarding, and schedule, cycle, or otherwise control the operations of pumps, filtering systems, laminar jets, massaging jets, automated cleaning and/or chemical dispersal systems, and other equipment needed for the general operation of a pool and/or spa. In this respect, such PSC panels are capable of being, and are often used as, a main control of a large multi-component pool automation system that dictates the operations of each piece of equipment associated with a pool and/or spa.

Further, inherent in their function to control device operations, PSC panels can be used to coordinate operations of one or groups of devices relative to another one or group of devices. To do this, PSC panels may incorporate high voltage relays (known with the art and sometimes referred to herein as "control points," or auxiliary outputs, relays, or connections) that can be independently controlled by the PSC panel (and thereby a pool owner or user). As a result, these PSC panels are often installed with pools and spas that incorporate various combinations of lighting technologies described above (zoned and un-zoned). While these PCS panels can offer an efficient solution for centralizing control of multiple devices, and provide zoned lighting schemes desired by many pool owners and users, they are not without drawbacks.

For example, a pool owner may need or want independent control of pool light(s), spa light(s), bubblers, a waterfall, massaging jets, and any lights associated with these last three types of devices. Each of theses devices, to be controlled by a PSC panel, must connect to a high voltage output relay of the PSC panel (i.e., a relay on a "high side" of a power supply), but supplied with a low voltage that each is designed to be powered by. Thus, an installation of the desired devices and lights with the PSC panel would require a high to low voltage transformer for each of the pool lights and spa lights, each of the devices, and potentially each light or group of lights respectively associated with those devices (independent of the devices themselves). This technique of using multiple high voltage transformers increases the complexity of installation and operation (for example multiple high voltage switching operations) of lighting systems of pools and spas. Furthermore, there are significant material, equipment, and labor costs (to levels that, for many, are prohibitive) associated with this technique.

Improved techniques of controlling low voltage devices are described in U.S. Pat. No. 10,299,342 ("the '342 patent") and its related applications, which have one or more common inventors with the present disclosure and are expressly incorporated by reference in their entireties. In one example of an improved technique, the '342 patent describes a system that can have a device controller with a power source electrically coupled to a power input, a transformer electrically coupled to the power input, and multiple power interruption mechanisms electrically coupled in parallel with a same low voltage side of the transformer. The transformer may convert the power input from a high-voltage alternating current ("AC") input to a low-voltage output source on a second side (same low voltage side). Each of the multiple power interruption mechanisms may have at least one relay electrically coupling the low voltage side to a respective load powered by the device control system, such that power to the load can be selectively interrupted by that relay based on a signal from the device controller. Each power interruption mechanism can be configured as an individually addressable mechanism, and as a result, the device control system is enabled to control multiple individually-regulated components coupled to the relays, with the (one) transformer.

While the example device control systems described in the '342 patent generally address the issue of having to install multiple transformers (as well as having to employ "high side switching"), they do not, by and of themselves, address this issue specifically with respect to PSC panels. That is because, as discussed above, typical PSC panels employ a series of high voltage output relays to operate low voltage powered devices like LED lights and other devices described herein. The examples described in the '342 patent, even those that incorporate an "external controller," lack a capability to interface directly with such relay outputs of PSC panels as a result of being connected to, and powered by, a low side of a transformer.

However, in the pool and spa construction industry, both residential and commercial segments, PSC panels of the types described above, were used in a substantial portion, if not a majority of, pool system installations completed in the recent previous few years. Furthermore, PSC panels continue to be used in pool system installations that involve lighting and other low-voltage device control systems—a trend that is expected by those in the industry to continue for the foreseeable future. Thus, there is a greater need for devices and ways in which the exemplary device control systems described in the '342 patent, can be added on/incorporated into pool systems that utilize PSC panels.

As a result, a need exists for devices and methods that enable device control systems including individually addressable relays used to control multiple low voltage devices, to directly interface with PSC panels including high voltage output relays.

SUMMARY

Examples described herein include a circuit interface (referred to herein by name or as "CI") that can include a plurality of inputs, an internal controller, and a communication module. Each of the inputs may be configured to connect to a respective high voltage relay output of a pool and/or spa control PSC panel. The internal controller may be connected to the plurality of inputs, and together, the internal controller and the plurality of inputs can be configured to convert relay output signals into formatted data that includes an implementation protocol. The communication module can be configured to transmit the formatted data from the circuit interface. Conversions from the relay output signals to the formatted data can include specifying or configuring the formatted data to cause a device controller to operate devices corresponding to respective PSC panel relay outputs by directing individual low voltage supplies from a common low voltage source to the respective devices.

In another example, a device control system includes a power transformer, a plurality of switches, a device controller, and a circuit interface in communication with the device controller. In one example, the power transformer can be configured to connect to a high voltage power source, and each switch can be configured to be connected to a device that is powered by a supply of low voltage. In another example, the device controller can be configured to implement the power transformer and the plurality of switches based on formatted data received from the circuit interface. In one example, the circuit interface can include a plurality of inputs, an internal controller, and a communication module. Each of the plurality of inputs can be configured to connect to a respective relay output of a PSC control panel and the internal controller. Together, the internal controller and the plurality of inputs can convert relay output signals into formatted data that includes an implementation protocol. The communication module can transmit the formatted data from the circuit interface to the device controller. In another example, the device controller can process the formatted data and implement the power transformer and the plurality of switches based on the formatted data to control operations of devices connected to the plurality of switches, each device configured to respectively correspond to a PSC panel relay output.

Both the foregoing general description and the following detailed description are exemplary and explanatory only and are not restrictive of the examples, as claimed.

DESCRIPTION OF THE EXAMPLES

Figure 1:
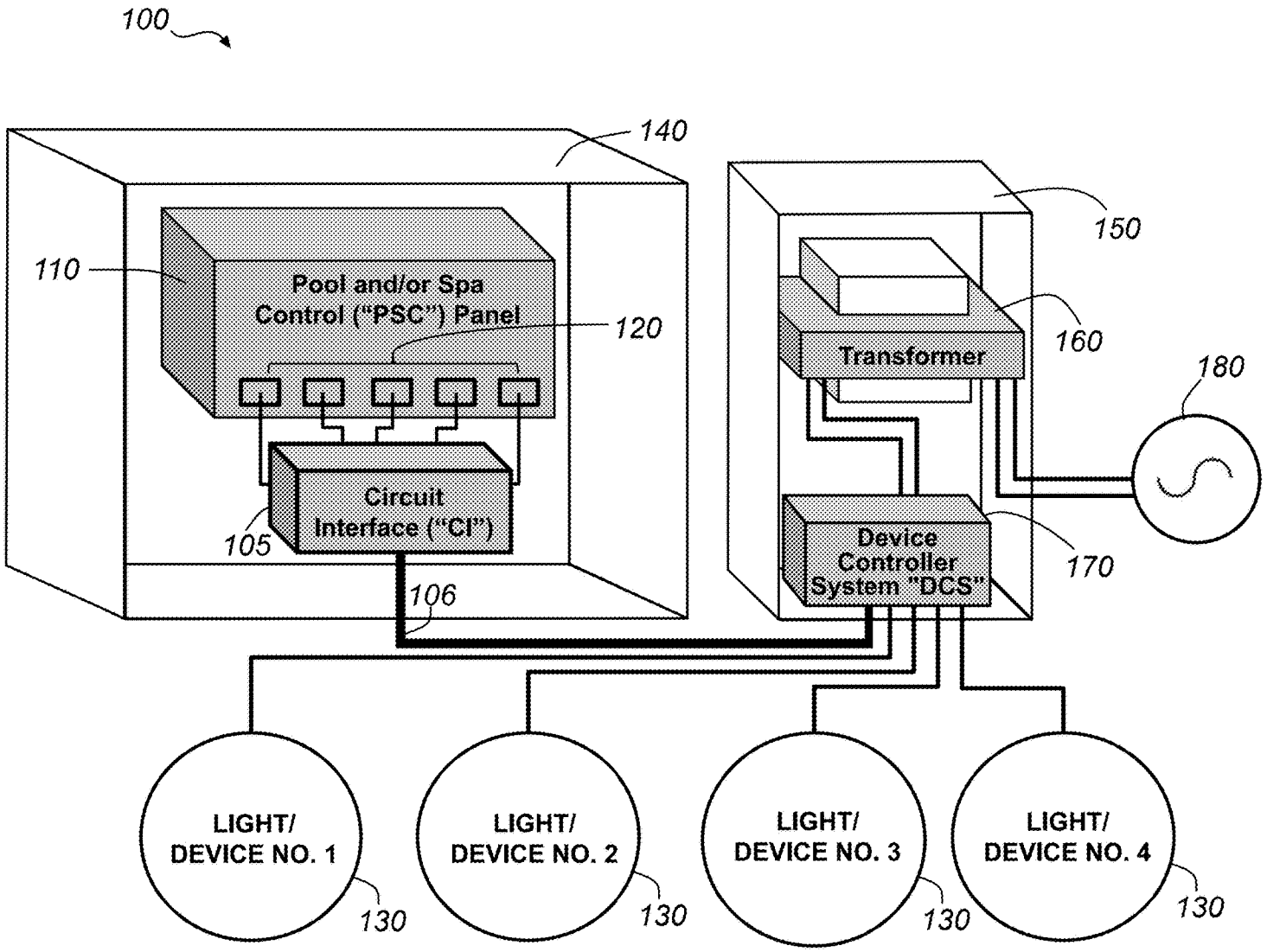
FIG. 1 illustrates an integrated system including an exemplary circuit interface incorporated with a PSC panel and integrated with a device controller system ("DCS") according to aspects of the present disclosure.

Reference will now be made in detail to the present examples, including examples illustrated in the accompanying drawings. Wherever possible, the same reference numbers will be used throughout the drawings to refer to the same or like parts.

However, reference numerals and terminology used herein are for the purpose of describing particular aspects only and are not intended to be limiting. For example, as used herein, the singular forms—"a," "an," and "the"—are intended to include the plural forms as well, unless the context clearly indicates otherwise. As another example, recitation of ranges of values herein are merely intended to serve as a shorthand method of referring individually to each separate value falling within the range. Unless otherwise indicated herein, and each separate value is incorporated into the specification as if it were individually recited herein.

Furthermore, it is noted that any one or more aspects or features described with respect to one example, may be incorporated in different examples described herein, although not specifically referred to or otherwise described relative thereto. That is, all examples and/or features of any aspect described herein can be combined in any way and/or combination. Thus, all methods described herein can be performed in any suitable order unless otherwise indicated herein or otherwise clearly contradicted by context.

FIG. 1 illustrates an integrated system 100 including an exemplary circuit interface 105 that is incorporated with a PSC panel 110, and integrated with a device controller system 170 ("DCS 170") through a first conduit 106 carrying one or more signal-carrying elements (e.g., wires, fiber-optic cables, coaxial cables, etc.). More specifically, the circuit interface 105 is provided in a first housing 140 for the PSC panel 110, and directly connected to relay outputs 120 of the PSC panel 110.

It will be understood that the DCS 170 and the PSC panel 110 include or otherwise incorporate a computing device that includes one or more processors and a memory storage including a non-transitory, computer-readable medium having instructions. Either of or both the DCS 170 and the PSC panel may, with their respective processors, execute respective instruction to cause those respective processors to perform various stages described herein.

The DCS 170 may be provided in a second housing 150 in which a transformer 160 is disposed. The transformer 160 includes circuitry that is connected to a first power source 180 (e.g., a high voltage AC power source) serving as a power input for the DCS 170. In one example, the transformer 160 converts an output of the first power source 180 from a high voltage AC input on a high voltage side of the transformer 160, to a low voltage power output appropriate or otherwise rated for powering low voltage lights or other devices 130 ("low voltage device 130") illustrated in FIG. 1. The DCS 170 operates several low voltage switches (e.g., relays, metal-oxide-semiconductor field-effect transistors (MOSFETS), or the like) in order to operate the low voltage devices 130. More specifically, the DCS 170 controls the operations of the low voltage devices 130, individually and relative to each other, by implementing the single high voltage transformer represented by transformer 160.

Each relay output 120 of the PSC panel 110 corresponds with one of the low voltage device 130 that are controlled by the DCS 170, as indicated in FIG. 1. In one example, communication between each input of the circuit interface 105 and a respective output relay 120 may be configured to electrically isolate a control point represented by the respective output relay 120. The circuit interface 105 can be configured to read a state, or change in state, of each individual output relay 120 independently of every other output relay 120 to which the circuit interface 105 is connected, coupled, or otherwise in communication with. In another example, the circuit interface 105 may employ different types of components to facilitate (isolated) communication with each relay output 120—the type of component dictating how relay output signals from the relay output 120 are converted into formatted data by the interface circuit 105.

More specifically, the circuit interface 105 can convert state information, or other information represented by an output signal from one of the high voltage output relays 120 the circuit interface 105 is able to read, into formatted data. This formatted data can be transmitted by the circuit interface 105 to the DCS 170 through the first conduit 106. As illustrated, the circuit interface 105 can be directly connected (e.g., wired) to the DCS 170 by the first conduit 106. In one example, a configuration of the first conduit 106, meaning a type and physical structure of one or more transmission elements carried therein, is dependent on a type of implementation protocol that the circuit interface 105 normally includes in the formatted data. In other examples, the circuit interface 105 may be configured to generate multiple types of implementation protocols (e.g., serialized, non-serialized), and the first conduit 106 carries the maximum number of signal transmitting elements required for any one type of implementation protocol the circuit interface 105 can potentially generate.

Aspects of the present disclosure related to the circuit interface 105 generating or determining formatted data and implementation protocols, are discussed in more detail with reference to FIG. 2. Use of the formatted data by the DCS 170 to operate the low voltage devices 130 is described in more detail with reference to FIG. 3.

Figure 2:
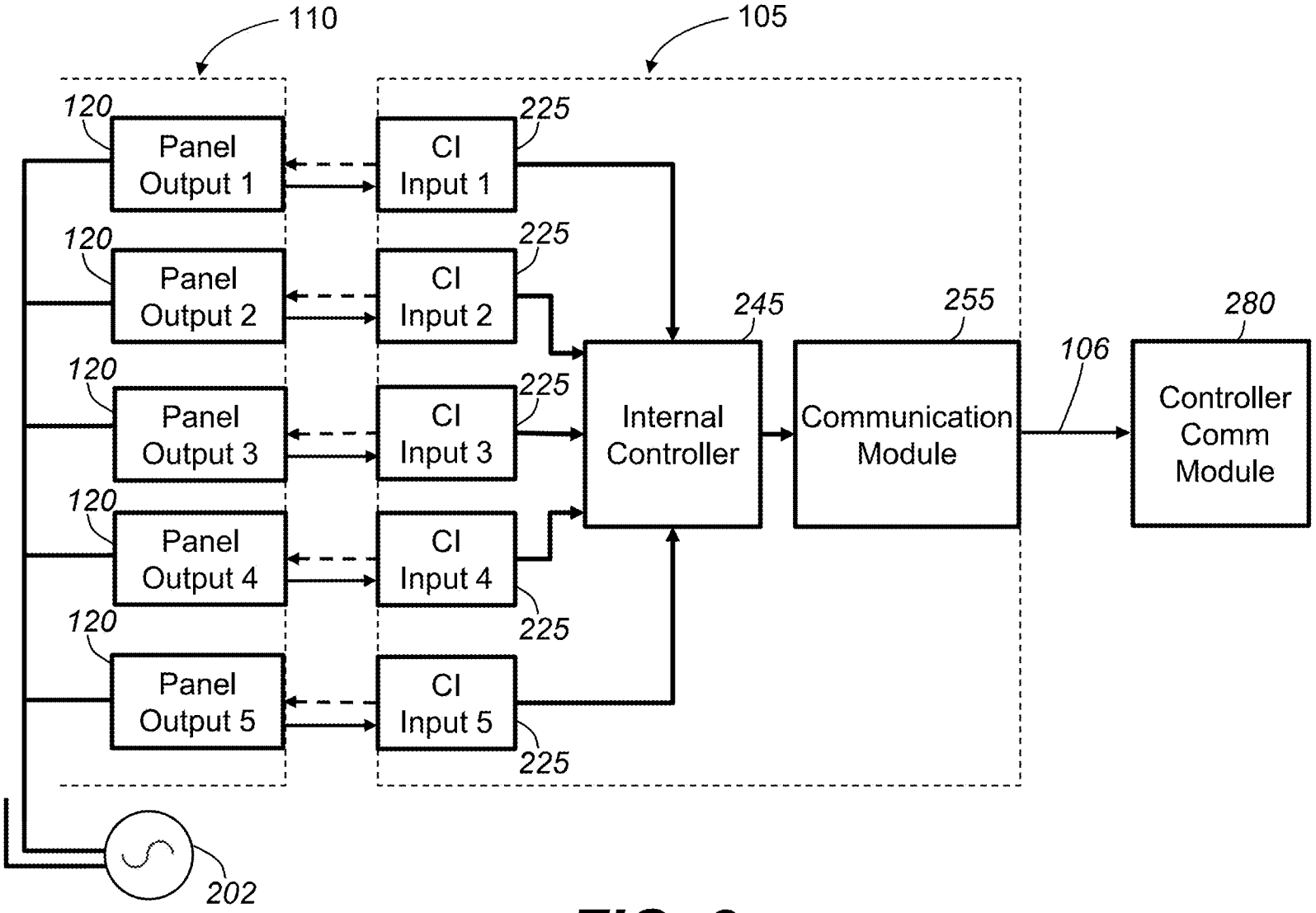
FIG. 2 illustrates a schematic view of an exemplary circuit interface integrated with a PSC panel.

FIG. 2 illustrates a schematic view of the exemplary circuit interface 105 integrated with the PSC panel 110. As illustrated, the circuit interface 105 includes several interface inputs 225, each in communication with an internal controller 245 of the circuit interface 105, and a respective high voltage relay output 120 of the PSC panel 110. The solid arrows between each relay output 120 and interface input 225 pair indicates the direction of output relay signals from the relay output 120 to the interface input 225. The dotted arrows indicate the connection or plugging of the interface input 225 to or into the relay output 120. The internal controller 245 is also connected to or otherwise communicates with a communication module 255.

It will be understood that the internal controller 245 can include or otherwise incorporate a computing device that includes one or more processors and a memory storage including a non-transitory, computer-readable medium having instructions. The internal controller 245 can execute the instructions provided therein with a respective processor, to cause the respective processor to perform various stages described herein associated with the circuit interface 105. Additionally, example processes described herein with respect to circuit interfaces may be implemented in a system, such as a device controller system or an external controller integrated with a circuit interface according to the present disclosure. The exemplary system may include a memory storage and a computing device having a processor that executes instructions to carry out, or cause a circuit interface to carry out, processes associated with the circuit interface.

A communication module as referred to herein can include one or more communication ports configured to provide a signal transmission path(s) between to two devices. The communication module 255 can transmit information from the internal controller 245 to an external piece of equipment, computing device, electrical circuit, or the like. In the instant example, the communication module 255 is connected by transmission components (e.g., a cable, a wire, cables, wires) carried in or provided by the first conduit 106 to a communication port 280 of the DCS 170 (not shown).

In one example, each of the interface inputs 225 includes an opto-isolator that transfers high voltage electrical signals (i.e., output relay signals), from a respective high voltage output relay 120, to the internal controller 245, using light. More specifically, each interface input 225 may include a source of light, an optical channel, and a sensor. The source of light can include light emitting components, such as an LED, that converts a high voltage electrical signal from a respective relay output 120 into light. The optical channel may be a closed optical channel. The sensor may be provided as a photosensor that detects incoming light and either generates electric energy directly, or modulates electric current flowing from an external power supply. A sensor provided in each opto-isolator may include a photoresistor, a photodiode, a phototransistor, a silicon-controlled rectifier ("SCR"), or a triode for alternating current ("TRIAC").

Opto-isolators that implement analog or digital signal processing can be employed as the interface inputs 225 in various examples of the circuit interface 105 according to the present disclosure. In some examples in which opto-isolators are provided for the interface inputs 225, each opto-isolator may employ a first LED to convert a relay output 225 into light, and second LED to sense the light emitted by the first LED. This construction provides a symmetrical and bi-directional opto-isolator, that can, regardless of polarity of a wire or other electrical transmission component connected to a relay output 120 and an interface input 225, convert the high voltage electrical signal from the relay output 120 into a light signal(s) that can be processed by the internal controller 255. In other words, employing bi-directional opto-isolators eliminates a need for polarity matching when connecting to examples of a circuit interface as described herein.

As discussed above, each interface input 225 can include or be provided as an opto-isolator. In other examples according to the present disclosure, each interface input 225 includes an electrical connector, such as a terminal, socket, or plug, that does not include an opto-isolator, and is in some way connected (e.g., wired, plugged-in) to a respective relay output 120. The type of component incorporated as the interface input 225 for a particular example of the circuit interface 105 will correspond to an exemplary process employed by the circuit interface 105 for converting high voltage relay output signals into formatted data that can be processed by the DCS 170.

More specifically, a type of component used for the input interfaces 225 depends from a distribution and type of operations that encompass an overall conversion process. In the case of opto-isolators, the interface inputs 225 perform reception, initial conversion, and respective transmittance sub-processes within an overall conversion process. More specifically, by converting relay output signals into light, transmitting the relay output signal constitutes the transmission by the input interface of a representation of the relay output signal to the internal controller 245.

On the other hand, where one or more interface inputs 225 include an electrical connector without an opto-isolator, those interface inputs 225 perform reception and respective transmittance sub-processes within an overall conversion process. As a result, the internal controller 245 may employ other components and processes to complete the overall conversion process of the output relay signals into formatted data. For example, the internal controller 245 may process the relay output signals using a signal transformer, transistor, a full bridge rectifier, or the like.

In other examples, the internal controller 245 can be configured to process signals from multiple types of components provided for the interface inputs 225. Thus, in some examples, the interface inputs 225 may include a combination of opto-isolators and other types of electrical connectors that receive output relay signals and transmit some respective form or representation of the output relay signals to the internal controller 245.

In one example, the internal controller 245 includes a microcontroller that converts signals received from the interface inputs 225 into formatted data that can be read by the DCS 170. Converting a received signal includes characterizing, in some form, a control single (e.g., ON, OFF, ON/OFF sequences) from the PSC panel 110, the received signal represents. In addition, the internal controller 245 generates an implementation protocol based on how the formatted data is going to be transmitted to the DCS 170.

In one example, generating an implementation protocol includes serializing the received signals. In this example, the internal control may serialize the received signals according to the interface input 225 that transmitted it. As a result, the serial communication thereby serves as an implementation protocol for operating multiple low voltage devices. This is because the serial communication effectively identifies the interface input 225 it receives a signal from and the content of that signal (what it represents operationally). It follows that by a respective connection to a particular relay output 120, an interface input 225 corresponds to a low voltage device 130 that the PCS panel 110 recognizes as being controlled by the control signals of the relay output signals from that relay output 120.

In other examples, the received signals may be serialized additionally by taking into account an order in which the internal controller 245 received them. Implementations in which the internal controller 245 generates a serial communication may be performed by examples of the circuit interface 105 that include a single communication port provided as the communication module 255. Accordingly, the first conduit 106 may carry a single cable that transmits the formatted data including the implementation protocol to the controller communication module 280.

In other examples, an implementation protocol generated by an internal controller 245 does not include a serialized communication, or does not employ a serialized communication with respect to the signals received from all the interface inputs 225. Rather, some examples of the circuit interface 105 that include multiple communication ports for the communication module 225 can send a portion or all of the formatted data through individual communication ports that may be set to correspond to specific interface inputs 225. In this example, an implementation protocol generated by the internal controller may be distributed to each communication port in total or in part.

In one example of the protocol being distributed in parts, each part will be specific to the low voltage device corresponding to the input interface 225 the internal controller 245 receives a signal from. In another example of protocol distribution in parts, each part may provide a partial serial communication in that the part may identify a low voltage device and its respective operation to be performed before and after an operation of the low voltage device 130 for which that part of the implementation protocol is being transmitted to.

The communication module 255 is configured to transmit the formatted data from the internal controller 245 to a device controller communication module 280 provided in the DCS 170. Thus, in some examples, the communication module 255 can include a single port that transmits data according to a particular standard of communication such as RS-485. In this example, the internal controller may serialize the signals received from the interface inputs 225. The communication module 255 may include transmitting (TX) components (e.g., pins) and receiving components (e.g., pins) packaged together in a serial port or adaptor (e.g., a TX/RX port or adaptor).

In other examples, the communication module 255 may include several ports, each corresponding to an interface input 225. This configuration of components would be provided in examples of the circuit interface 105 in which the internal controller 245 employs a distributed implementation protocol.

In many systems employing both PSC panels 110 and lights or other low voltage devices 130, operation of the devices 130 is orchestrated through the PSC panel 110. This is often because the PSC panel 110 may be the most cost-effective option for operating these low voltage devices 130 in concert with the operations of other pool and spa equipment. In other situations, the PSC panel 110 may incorporate software products that can be used by pool owners/maintenance personnel to set up, monitor, and receive alerts about operations of different components of the pool system managed by the PSC panel 110. In addition, these products may offer robust interfaces that enable users to quickly set up complex sequences/schedules of operations. Thus, many PSC panels 110 can offer complete system operation platforms that can tie the operation of zoned lighting systems, for example, and related low voltage devices, to accessible, centralized, and user-friendly tools that allow users to define, modify, or stop light system and device operations.

As shown, in FIG. 2, the output relays 120 are connected to a second high voltage power source 202. This is shown as a direct connection, but it will be understood by those of ordinary skill in the relevant art, that one or more of the output relays may be connected to the second power source 202 through circuitry having one or more electrical components. Absent the circuit interface 105 and DCS 170 of the present disclosure, the output relays 120 would be electrically connected with each of the low voltage devices 130 by a transformer dedicated to the operation of that low voltage device 130. Thus, the circuit interface 105 provides a cost-effective, versatile, and highly adaptable solution to the high costs and operational inefficiencies of employing high voltage switching with a high voltage transformers for each low voltage device the PSC panel 110 controls the operation.

Figure 3:
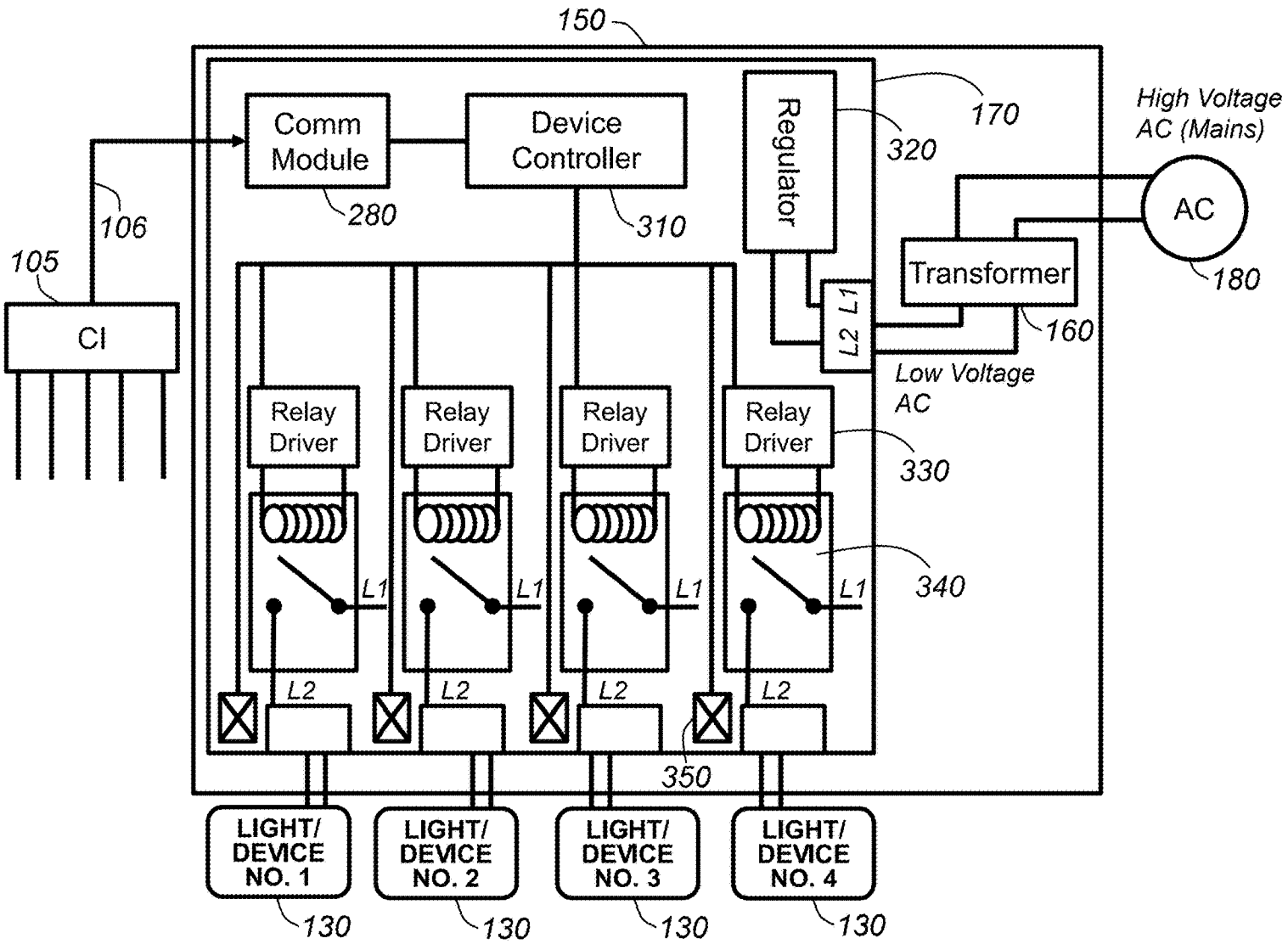
FIG. 3 illustrates a schematic view of an exemplary circuit interface integrated with a DCS, according to aspects of the present disclosure.

FIG. 3 illustrates a schematic view of an exemplary circuit interface 105 integrated with the DCS 170, according to aspects of the present disclosure. Similar DCSs are described in the '342 patent previously mentioned, and incorporated by reference herewith.

Energy from the high voltage AC power source 180 is coupled to the DCS 170 through the transformer 160, which is connected to the two connection leads L1 and L2. Power can be provided from a low voltage side of the transformer 160 to each of the relays 340 illustrated in FIG. 3. The DCS 170 couples the two connection leads L1 and L2 to each of a plurality of relays 340 through a voltage regulator 320. More specifically, for each relay 340, an L1 connection lead can be connected to the relay 340 and the voltage regulator 320. The voltage regulator can be an electronic circuit that provides a stable direct current (DC) voltage independent of a load current, temperature, and AC line voltage variations.

The DCS 170 also includes a device controller 310 that interfaces with each of the relays 340, and each relay driver 330 associated with each relay 340. Operation of each of the relays 340 can be directly caused by an operation of a respective relay driver 330, which is controlled by the device controller 310. More specifically, during operation, the relay 340 can switch connection L1 to a load when commanded by device controller 310 through a respective relay driver. As a result, the device controller 310 can implement ON/OFF timing characteristics on a low voltage side of the DCS 170 for a variety of lighting and low voltage products.

The DCS 170 further includes the communication module 280 of the DCS 170 introduced in FIG. 2, and the device controller 310 is in communication with the communication module 280. With the device controller 310, the DCS 170 is configured to control each of the circuits incorporating a relay 340 based on input (e.g., data, electrical signals, light signals, etc.) received from the communication module 280, and thus, from the circuit interface 105. The DCS 170 includes at least two connection leads L1 and L2 coupled to each of a plurality of relays 340, through a voltage regulator 320. The voltage regulator can be an electronic circuit that provides a stable direct current (DC) voltage independent of a load current, temperature, and AC line voltage variations. For each relay 340, an L1 connection lead is connected to the relay 340 and the voltage regulator 320.

Each relay 340 can further include a power monitoring circuit 350 configured to monitor an amount of current cycling throughout the DCS 170, and a nature/quality of the current. This in turn serves as a measure of the quality of power provided and shunted by a relay 340 to a respective low voltage device 130. In another example, the monitoring may include monitoring the overall current being utilized on a respective relay 340, overall power consumption, component power consumption, quality of the power provided, and similar data on the power and how it is being used. For these functions, the monitoring circuit 350 may incorporate a Hall-effect sensor, a fluxgate sensor, a fiber-optic current sensor, a Rogowski coil type sensor, and the like.

Each relay 340 can further include a power monitoring circuit 350 configured to monitor an amount of current cycling throughout the DCS 170, and a nature/quality of the current. This in turn serves as a measure of the quality of power provided and shunted by a relay 340 to a respective low voltage device 130. In another example, the monitoring may include monitoring the overall current being utilized on a respective relay 340, overall power consumption, component power consumption, quality of the power provided, and similar data on the power and how it is being used. For these functions, the monitoring circuit 350 may incorporate a Hall-effect sensor, a fluxgate sensor, a fiber-optic current sensor, a Rogowski coil type sensor, and the like.

Incorporation of the monitoring circuit 350 enables the device controller 310 to have the capacity to monitor and report energy or power usage, and various parameters describing the quality of the energy supplied to the light(s). Furthermore, direct control over a "powering on" function and communication with the various elements connected to the communication module 280, in addition to the circuit interface 105. This can include, for example, scheduling operation times, scheduling maintenance periods, controlling operating modes, controlling operating parameters (e.g., brightness, color, etc.), controlling power consumption, controlling power usage, controlling overall power costs, and the like. The power monitor circuit 350, along with the data it collects, can also be utilized, to enable a user to monitor energy efficiency in real time, and adjust the systems operations to maximize energy savings, for example, by coordinating the scheduling of peak consumption operations with off-peak utility hours. However, the above functions, others provide by the DCS 170, were not previously available for pool automation systems including PSC panels since output relay signals required the conversion performed by the circuit interface's described herein.

It is noted that the relays 340 are depicted as Single-Pole Single-Throw (SPST) relays, but in some examples could be provided in Single-Pole Double-Throw (SPDT), Double-Pole Double-Throw (DPDT), and other relay configurations. In another example, one or more of the relays 340 may comprise analog or solid state switches or relays, including, but not limited to, electromagnetic relays, reed relays, hybrid relays, thermal relays, MOSFET relays, TRIAC- and SCR-based devices, and similar analog and solid state relays.

Figure 4:
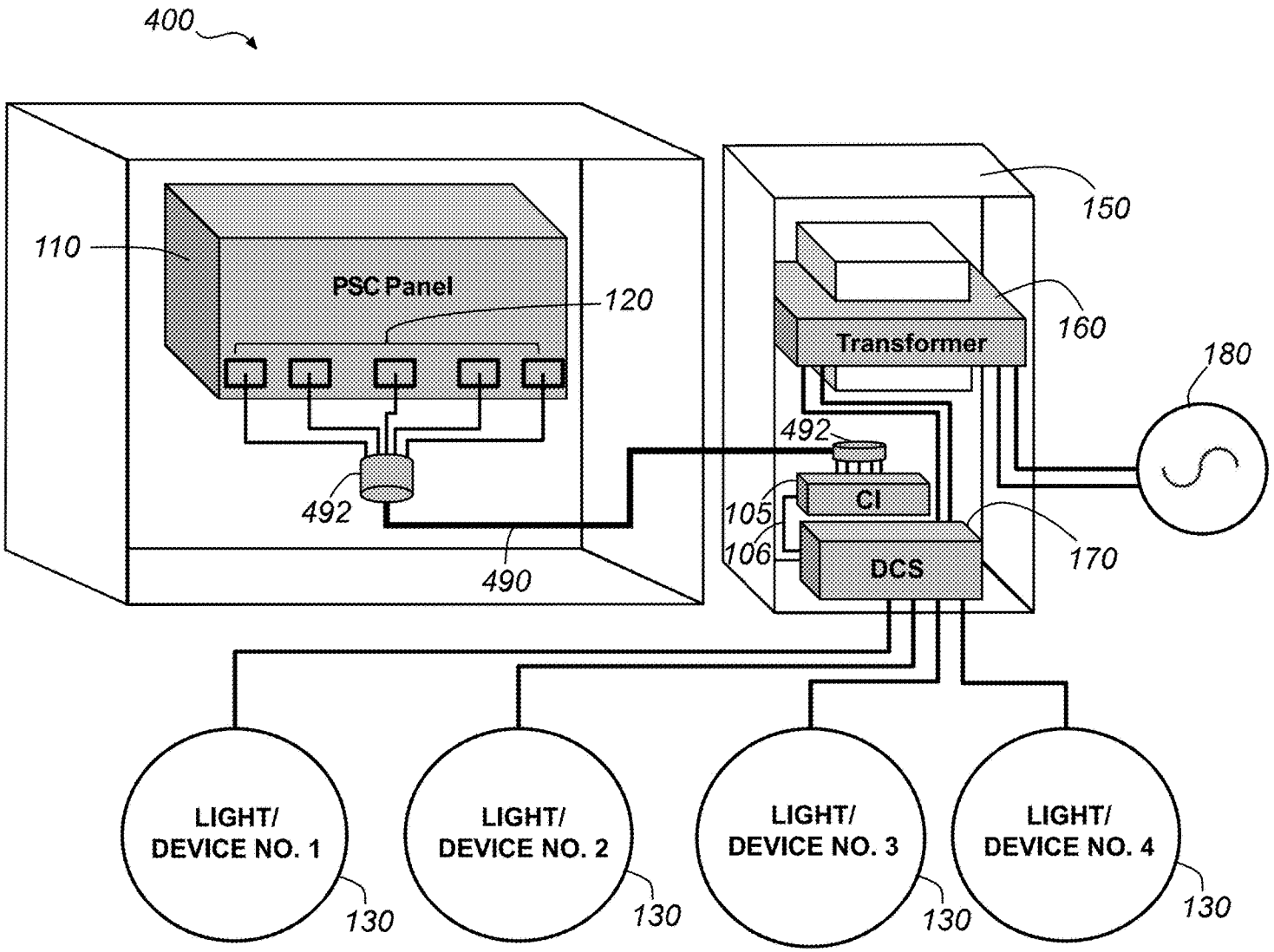
FIG. 4 illustrates an integrated system including an exemplary circuit interface integrated with a PSC panel and incorporated with a DCS, according to aspects of the present disclosure.

FIG. 4 illustrates an integrated system 400 including the exemplary circuit interface 105 integrated with the PSC panel 110 and incorporated with a the DCS 170, according to aspects of the present disclosure. In the integrated system 400, the circuit interface 105 is provided in the housing 150 with the DCS 170 and the transformer 160. As in other examples, the circuit interface 105 is connected to the DCS 170 by the first conduit 106. A second conduit 490 is provided for carrying the high voltage signals from the output relays 120 to the circuit interface 105. High voltage sealing ends 492 may be provided at each end of the second conduit 490.

Figure 5:
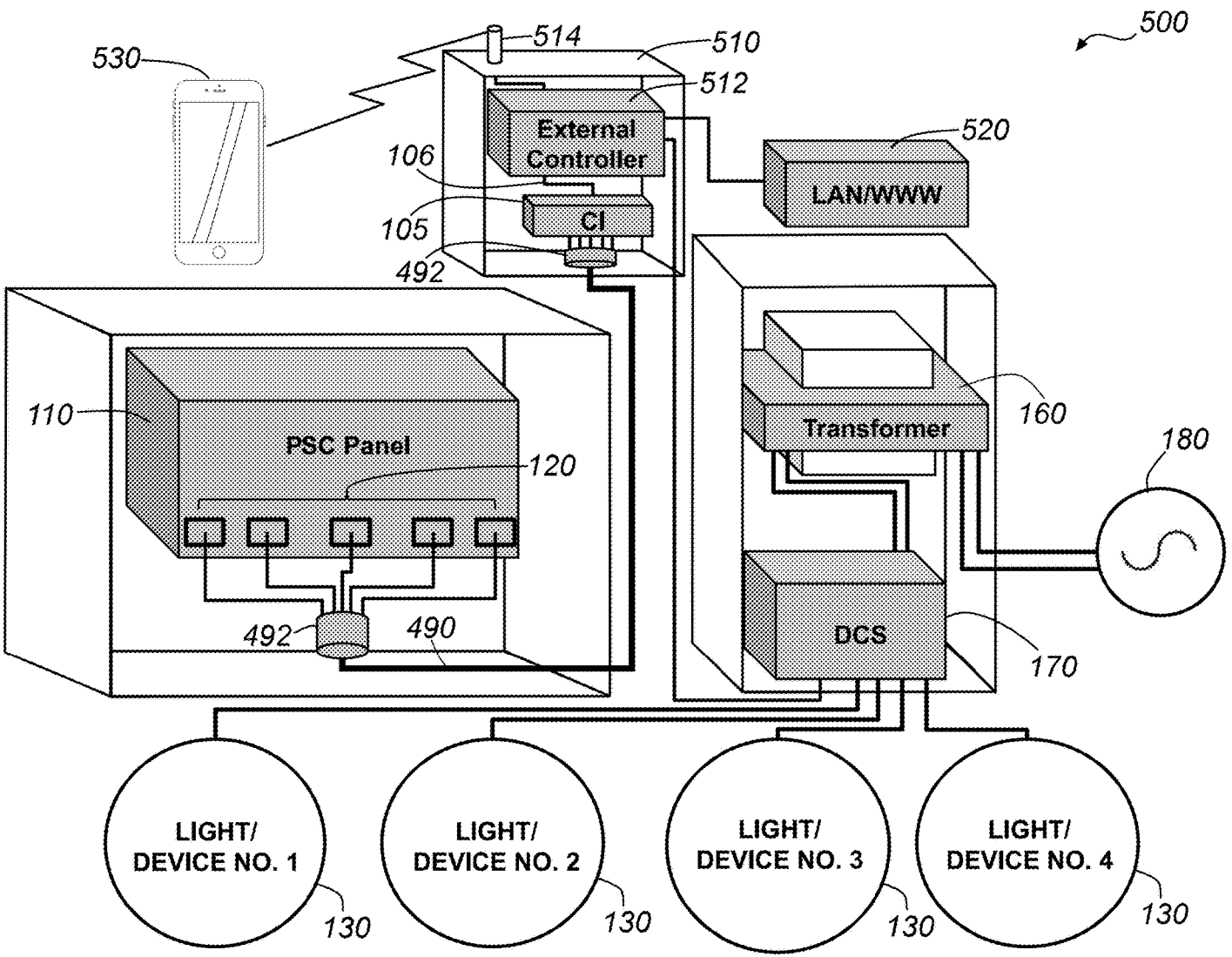
FIG. 5 illustrates an integrated system including an exemplary circuit interface integrated with a PSC panel and incorporated with an external control device ("ECD") that integrates the circuit interface with a DCS through an external controller, according to aspects of the present disclosure.

FIG. 5 illustrates an integrated system 500 including the exemplary circuit interface 105 integrated with the PSC panel 110 and incorporated with an external control device 510 ("ECD 510") that integrates the circuit interface 105 with the DCS 170 through an external controller 512, according to aspects of the present disclosure. The circuit interface 105 is connected to the PSC panel 110, as in other examples, with the second conduit 490, and connected to the external control 512 by the first conduit 106.

The external controller 512 of the ECD 510 is similar in many respects to external controllers described in the '342 patent. More specifically, the external controller 512 may direct, control, or select ON/OFF timing characteristics. Further the external controller 512 can provide the input to the DCS 170 through, for example, the communication module 280, to adjust control schemes. Input form the external controller 512 can be based on user input received, for example through a network connection 520 to a network. Further, the external controller 510 can be connected to different types of networks, and thereby connected to different types of wired or wireless computing devices 530, via, for example, a cellular or WiFi connection facilitated by a cellular/WiFi connection device 514.

Furthermore, the external controller can receive input from an external user interface (not shown) via one or more networks. Such user interfaces may be implemented wirelessly through one or more wireless enabled devices, such as, for example, a portable smartphone, electronic tablet, computer, or the like. Software used from an external interface can be installed on any device mentioned above, or pushed through a wireless network as an application or similar software to appear on the device to control direct operations of the DCS 170. In other examples, the external controller 512 may be provided as a hard-wired or imbedded graphical user interface ("GUI"), provided at or in close proximity to DCS 170 and enable the same or similar direction or control over the operation DCS 170 as described above.

As noted above, the external controller 512 is similar to external controllers described in the '342 patent. To the extent not stated herein, the external controller 512 may provide any and all functionality the examples in the '342 patent. However, the external controllers of the '342 are not enabled to interface with relay outputs of a PSC panel 110 as is the external controller 512 by way of its integration with a circuit interface 105 according to the present disclosure. Thus the circuit interface 105 can expand, not only the DCS 170 applicability to different pool automations systems, but also external controllers that often focus on providing users with control of these automation systems remotely.

Figure 6:
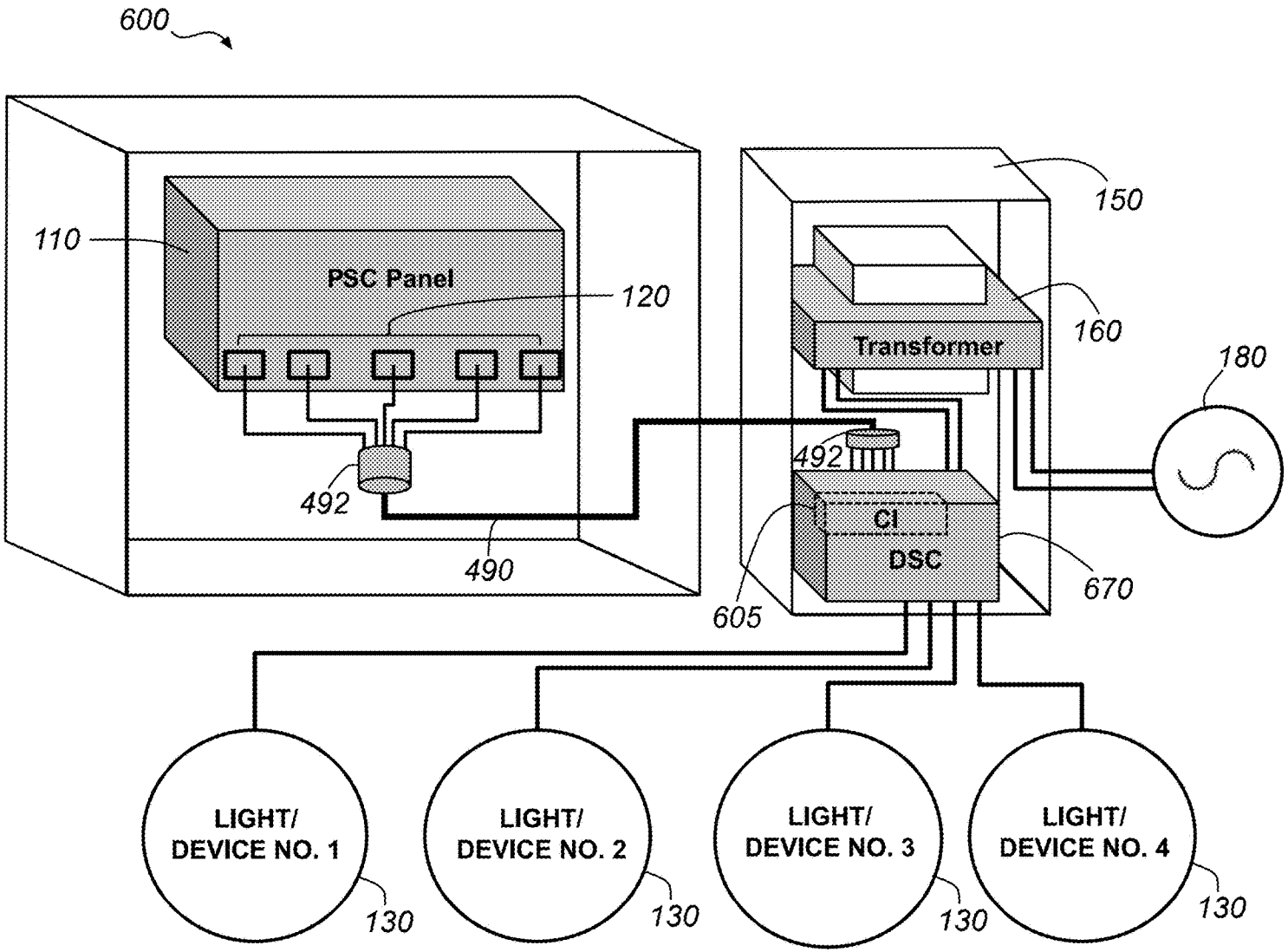
FIG. 6 illustrates an integrated system including an exemplary circuit interface incorporated with a DCS and integrated with a PSC panel, according to aspects of the present disclosure.

FIG. 6 illustrates an integrated system 600 including an exemplary circuit interface 605 incorporated with a device system controller 670 and integrated with the PSC panel 110 via the second conduit 490. The circuit interface 605 can include all the same components as other example described herein. However, in the integrated system 600, the circuit interface 605 is incorporated into a housing of a device system controller 670, according to aspects of the present disclosure. As are result, the circuit interface 605 may include addition electrical or other types of components (e.g., resistors, insulators, etc.) in order to adapt the interface inputs, internal controller, and communication module for operation within the DCS 670. In one example, the circuit interface 670 may be incorporated into a motherboard provided a device controller and switching components of the DCS 670.

Figure 7:
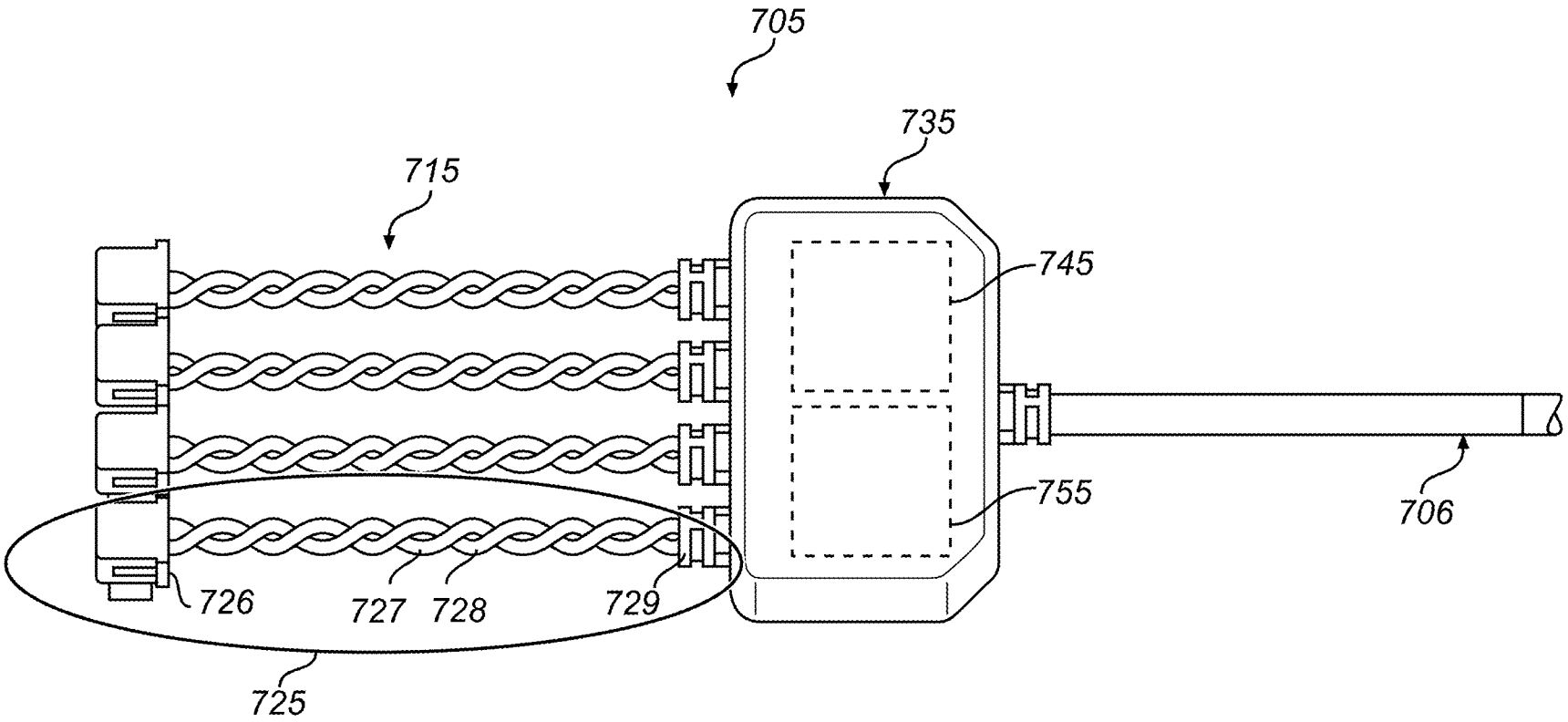
FIG. 7 illustrates an overhead view of an exemplary circuit interface, according to an aspect of the present disclosure.

FIG. 7 illustrates an overhead view of an exemplary circuit interface 705, according to an aspect of the present disclosure. More specifically, FIG. 7 illustrates a physical representation of a circuit interface configured for use as any example circuit interface described herein. The circuit interface 705 includes a set of connectors 715, each connector defining an interface input 725 and including a plug adaptor 726 extending from a first connection wire or cable 727 ("first connection 727") and a second connection wire or cable 728 ("second connection 728"). In some examples of the circuit interface 705 that incorporate opto-isolators for the interface inputs 725, a light emitter, sensor, and cable maybe provided within each plug adaptor 726. In other examples one or all of these sub-components may be disposed with a housing 735 of the circuit interface 705. An internal controller 745 and a communication module 755 are also provided in the housing 735, and a first conduit 706 extends from the housing 735.

In one example, each first connection 727 carries a control signal from a relay output of a PSC panel. Each second connection 728 caries a common signal from the same relay output. As illustrated in FIG. 7, each input interface 725 includes a two-connection hub 729 through which one of the four pairs of first and second connections 727, 728 extend into the housing 735 for respective connections with the internal controller 745. Accordingly, a hub and pair of connections is provided for each of four interface inputs 725 which corresponds to a particular low voltage device, such as one the low voltage devices 130 illustrated in FIG. 1, 3-6, or 8.

Alternatively, the circuit interface 705 can be provided with single connection hubs for each first connection 727 carrying a control signal, and an additional single connection hub for a single connection that carries the common signal. In this example, the common signals from all the relays output be may be tied together into an adaptor configured mate with an adaptor provided at the end of the common signal connection.

Figure 8:
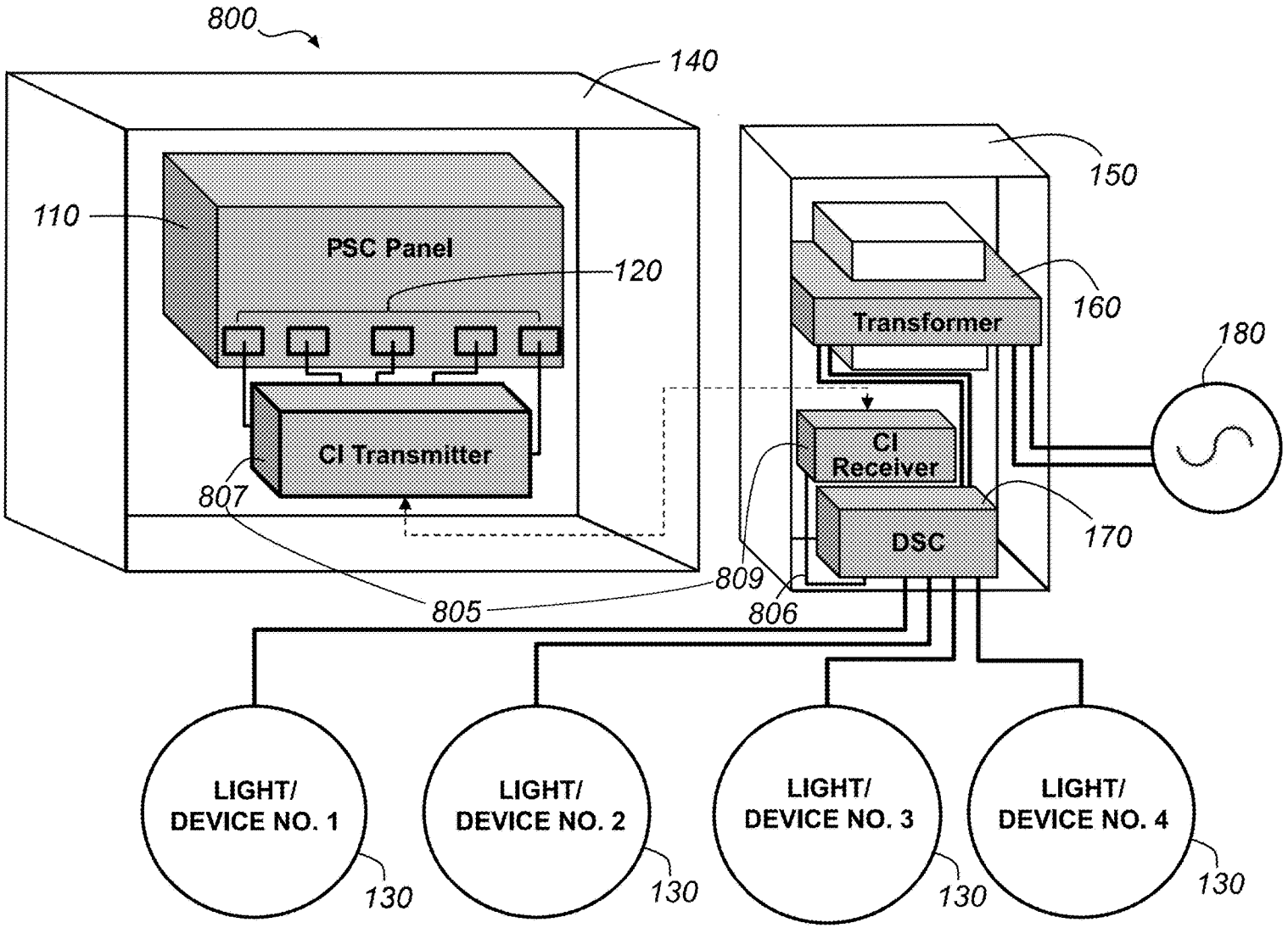
FIG. 8 illustrates an integrated system including an exemplary circuit interface incorporated in a PSC panel and a DCS, according to aspects of the present disclosure.

FIG. 8 illustrates an integrated system including an exemplary circuit interface 805 incorporated in the PSC panel 110 and the DCS 170, according to aspects of the present disclosure. As illustrated, the circuit interface 805 includes a first interface housing 807 that includes a wireless transmitter, and a second interface housing 809 that includes a wireless receiver configured to communicate with the wireless transmitter. The first interface housing 807 is disposed within the first housing 140 with the PSC panel 110, and the second interface housing 809 is disposed within the second housing 150 with the DCS 170.

Interface inputs and an internal controller of any of the respective types described herein, may be included in the first interface housing 807 with the wireless transmitter. The wireless transmitter can be configured to transmit formatted data from the internal controller in to the receiver, which can include a communication module as described herein. The communication module within the second interface housing 809 can in communication with the DCS 170 through a first conduit 806. Thus, formatted data provided by the internal controller can be wirelessly transmitted essentially from the PSC panel 110 to the DCS 170 in the integrated system 800 of FIG. 8. The formatted data can include an implementation protocol including as serial communication, or, alternatively a distributed implementation protocol as previously described with reference to FIG. 2.

Other examples of the disclosure will be apparent to those skilled in the art from consideration of the specification and practice of the examples disclosed herein. Though some of the described methods have been presented as a series of steps, it should be appreciated that one or more steps can occur simultaneously, in an overlapping fashion, or in a different order. The order of steps presented are only illustrative of the possibilities and those steps can be executed or performed in any suitable fashion. Moreover, the various features of the examples described here are not mutually exclusive. Rather any feature of any example described here can be incorporated into any other suitable example. It is intended that the specification and examples be considered as exemplary only, with a true scope and spirit of the disclosure being indicated by the following claims.

What is claimed is:

1. A circuit interface comprising:

a plurality of inputs, each of the plurality of inputs configured to connect to a respective high voltage relay output of a pool and spa control ("PSC") panel;

an internal controller connected to the plurality of inputs, at least the internal controller being configured to convert relay output signals into formatted data that includes an implementation protocol; and a communication module configured to transmit the formatted data from the circuit interface;

wherein conversions from the relay output signals to the formatted data include generating the implementation protocol and specifying the formatted data to cause a device controller to operate devices corresponding to respective PSC panel relay outputs by directing individual low voltage supplies from a common low voltage source to respective devices, wherein the internal controller determines a state of a relay output based on a relay output signal received from an input from the plurality of inputs that is physically connected to the relay output, and wherein each of the plurality of inputs includes at least one of an opto-isolator, a signal transformer, a transistor, and a full bridge rectifier.

2. The circuit interface of claim 1, wherein the implementation protocol causes the device controller to control operation of a multiple of the devices in accordance with relay output signals from corresponding PSC panel relay outputs, wherein the multiple devices are powered by a single transformer connected to a high voltage power source.

3. The circuit interface of claim 2, wherein the plurality of inputs connects to at least four relay outputs corresponding to at least four devices, each of the least four devices being one of a pool light, a landscape light, and a low voltage device not associated with a pool or a landscape.

4. The circuit interface of claim 1, wherein the implementation protocol includes a serial communication representing the relay output signals.

5. The circuit interface of claim 1, wherein each input of the plurality of inputs includes:

a first connection configured to physically connect to and carry control signals from a relay output, and a second connection configured to carry a common signal for a plurality relay outputs physically connected to the plurality of inputs and including the relay output.

6. The circuit interface of claim 1, wherein each input in a group of the plurality of inputs physically connects to and carries control signals from a relay output, and wherein at least one of the plurality of inputs not in the group physically connects to and carries a common signal from relay outputs physically connected to the inputs in the group.

7. The circuit interface of claim 1, wherein each of the plurality of inputs includes a bi-directional opto-isolator.

8. The circuit interface of claim 1, further comprising:

a first housing, the communication module disposed in the first housing;

a second housing, the internal controller disposed in the second housing;

a wireless receiver provided in the first housing in communication with the communication module; and a wireless transmitter provided in the second housing in communication with the internal controller, the wireless transmitter configured to provide the wireless receiver with the formatted data.

9. A device control system comprising:

a power transformer configured to connect to a high voltage power source;

a plurality of switches, each switch configured to be connected to a device that is powered by a supply of low voltage;

a device controller configured to implement the power transformer and the plurality of switches;

a circuit interface in communication with the device controller, the circuit interface including:

a plurality of inputs, each of the plurality of inputs configured to connect to a respective relay output of a pool and spa control ("PSC") control panel;

an internal controller connected to the plurality of inputs, at least the internal controller being configured to convert relay output signals into formatted data that includes an implementation protocol; and a communication module configured to transmit the formatted data from the circuit interface;

wherein the device controller is configured to process the formatted data and implement the power transformer and the plurality of switches based on the formatted data to operate devices connected to the plurality of switches, each device configured to respectively correspond to a PSC panel relay output.

10. The device control system of claim 9, wherein the plurality of inputs connects to at least four relay outputs corresponding to at least four devices, each of the least four devices being one of a pool light, a landscape light, and a low voltage device not associated with a pool or a landscape.

11. The device control system of claim 9, wherein the implementation protocol includes a serial communication representing the relay output signals.

12. The device control system of claim 9, wherein the internal controller determines a state of a relay output based on a relay output signal received from an input from the plurality of inputs that is physically connected to the relay output.

13. The device control system of claim 12, wherein each of the plurality of inputs includes at least one of an opto-isolator, a signal transformer, a transistor, and a full bridge rectifier.

14. The device control system of claim 9, further comprising:

a main housing, the device controller and plurality of switches disposed in the main housing;

a first housing of the circuit interface positioned in the main housing, the communication module disposed in the first housing;

a second housing of the circuit interface that is separate from and external to the first housing and the main housing, the internal controller disposed in the second housing;

a wireless receiver provided in the first housing in communication with the communication module; and a wireless transmitter provided in the second housing in communication with the internal controller, the wireless transmitter configured to provide the wireless receiver with the formatted data.

15. A system-implemented method utilizing a circuit interface, the system including the circuit interface and at least one controller including a processor and a memory storage including a non-transitory, computer-readable medium comprising instructions, the method comprising:

receiving, with each of a plurality of inputs of the circuit interface, respective high voltage relay output signals from a respective high voltage relay output of a pool and spa control ("PSC") panel in communication with the plurality of inputs;

converting the respective high voltage relay output signals into light signals;

transmitting, with the plurality of inputs, the light signals to the at least one controller;

converting, at least with the at least one controller, the light signals into formatted data that includes an implementation protocol based on which of the plurality of inputs respectively transmitted each of the light signals;

causing, with a communication module, a device controller to operate devices corresponding to respective PSC panel relay outputs by directing individual low voltage supplies from a common low voltage source to respective devices based on the formatted data wherein each of the plurality of inputs includes an opto-isolator.

16. The method of claim 15, wherein converting the high voltage relay output signals includes generating the implementation protocol to cause the device controller to control operation of a multiple of the devices in accordance with high voltage relay output signals from corresponding PSC panel relay outputs, and wherein the multiple devices are powered by a single transformer connected to a high voltage power source.

17. The method of claim 15, wherein converting the high voltage relay output signals includes generating the implementation protocol to include a serial communication representing the high voltage relay output signals.

* * * * *